United States Patent [19]

Reichert et al.

[11] Patent Number: 4,994,309

[45] Date of Patent: Feb. 19, 1991

[54] INSULATING MULTIPLE LAYER SEALED UNITS AND INSULATING

[75] Inventors: Gerhard Reichert; Michael Glover, both of Ottawa, Canada

[73] Assignee: Lauren Manufacturing Company, New Philadelphia, Ohio

[21] Appl. No.: 386,026

[22] Filed: Jul. 27, 1989

Related U.S. Application Data

[63] Continuation of Ser. No. 132,557, Dec. 14, 1987, abandoned.

[51] Int. Cl.[5] ..... E06B 3/24

[52] U.S. Cl. ..... 428/34; 428/35.7; 428/36.92; 428/910; 428/212; 52/788; 52/789; 52/790; 52/172; 52/398; 156/109

[58] Field of Search ..... 428/34, 910, 119, 437, 428/480, 412, 430, 441, 442, 212, 35.5, 36.6, 36.9, 36.92; 52/172, 171, 789–790, 398, 309.1, 309.14, 397, 398, 399, 788; 156/107, 109

[56] References Cited

U.S. PATENT DOCUMENTS

| | | | |
|---|---|---|---|
| 4,078,348 | 3/1978 | Rothman | 52/309.7 |
| 4,335,166 | 6/1982 | Lizardo et al. | 52/172 |
| 4,431,691 | 2/1984 | Greenlee | 52/171 |
| 4,551,364 | 11/1985 | Davies . | |
| 4,564,540 | 1/1986 | Davies et al. | 52/172 |
| 4,721,637 | 1/1988 | Suzuki et al. | 428/36 |
| 4,734,240 | 3/1988 | Chung et al. | 264/177.19 |

FOREIGN PATENT DOCUMENTS

| | | | |
|---|---|---|---|
| 1227943 | 4/1968 | United Kingdom | 428/34 |

*Primary Examiner*—Ellis P. Robinson
*Assistant Examiner*—Donald J. Loney
*Attorney, Agent, or Firm*—Wenderoth, Lind & Ponack

[57] ABSTRACT

There is described a multiple layer sealed glazing unit comprising two or more glazing layers arranged in a parallel spaced apart relation, with an insulating spacer made of oriented thermoplastic polymer material interposed between the separate glazing layers and adjacent to the periphery thereof. The required physical properties of the insulating spacer are substantially governed by controlling the degree and directions or orientation of the molecular structure of the thermoplastic material or materials from which it is formed. Typically, the orientation of the polymer material used to manufacture the insulating spacer is largely in the longitudinal axis of the spacer.

There is also described an insulating spacer for multiple layer sealed units. The spacer is formed from oriented thermoplastic polymeric material and among other physical properties of which, the thermal conductivity, coefficient of thermal expansion and dead bend properties are governed by controlling the degree and directions of orientation of the molecular structure of the material.

12 Claims, 3 Drawing Sheets

INSULATING MULTIPLE LAYER SEALED UNITS AND INSULATING

This application is a continuation of now abandoned application, Ser. No. 07/132,557 filed on Dec. 14, 1987.

FIELD OF SEARCH 428-34, 52-790, 52-398.

REFERENCES CITED

U.S. Patent Documents:
G. Kessler: 4,057,945
G. Kessler: 4,113,905
G. Kessler: 4,222,213
R. A. Lizardo et al.: 4,335,166
T. W. Greenlee: 4,431,691
C. Dawson: 4,479,988
G. V. Francis: 4,552,790
L. W. Davies et al.: 4,564,540
U. K. Patent Documents:
I. M. Ward et al.: 2,060,469

FIELD OF INVENTION

This invention relates to insulating multiple layer sealed units for the building envelope incorporating insulating spacers therefor and where the multiple layers are typically made from transparent glazing materials.

DESCRIPTION OF THE PRIOR ART

Insulating glass units generally consist of two or more parallel sheets of glass which are spaced apart from each other and which have the space between the panes sealed along the peripheries of the panes to enclose an air space between them. Spacer bars are placed along the periphery of the space between the two panes. These spacer bars are typically long hollow perforated metal sections, usually made from an aluminum alloy and fabricated either in the form of an extrusion or by rolling from flat strip material. The hollow interior of the spacer contains a desiccant material which is used to absorb any residual moisture that may be in the enclosed air and to soak up any additional moisture that may enter into the sealed unit over a period of time. The spacers are assembled into a generally rectangular-shaped frame typically using corner keys.

Units are constructed using either a single or dual seal. For single seal units, the structural, air and moisture vapour seal is combined in one seal. Sealant materials typically used with single seal design include either thermoplastic sealants such as butyl or thermosetting sealants such as polysulphide and polyurethane. In general, the thermosetting sealants are more permeable to moisture vapour than the thermoplastic sealants.

For dual seal units, there is an inner seal, as well as the main outer seal with the inner seal generally functioning as an additional moisture vapour seal. Typically, for dual seal units, the inner seal is a thermoplastic material such as polyisobutylene and a bead of the polyisobutylene is attached to the sides of the spacer adjacent to the glass sheets. The spacer frame is then placed between the panes and heat and/or pressure is applied to ensure that the polyisobutylene is compressed and fully wets out to the surface of the glass. For the second outer seal, typically a thermosetting sealant such as silicone or polysulphide is used and is applied in the outward facing perimeter channel between the two glass sheets.

For sealed units conventionally manufactured using corner keys, about 50 per cent of the moisture vapour entering the sealed unit is through the corner connections. Similarly, for sealed units filled with low-conductive gas about 50 per cent of the gas loss from the sealed units is through the corner connections. To improve the durability of sealed units, the corner connections can be eliminated and the metal spacer bar can be bent or stretch-formed around the corners. To complete the bent-corner spacer frame, the two ends of the metal spacer can be welded or brazed together. With the introduction of automated equipment, bent-corner spacer frames can be very efficiently fabricated.

One problem with conventional sealed glazing units is that because the aluminum spacer is highly conductive there is a thermal bridge between the glazing layers and this can cause perimeter misting or ice build-up under extreme weather conditions. The metal spacer also causes glass stress, especially with low-e coated glass. On cold, sunny days the centre of the interior glass heats up and expands but the material is constrained by the cold perimeter glass, creating stress in the glass. Under extreme conditions this stress can be sufficient to cause glass breakage. These problems related to the use of a conductive metal spacer are now becoming more significant with the introduction of high thermal performance glazing. Compared to conventional double glazing (R-2 centre glazing), high thermal performance units range in performance from R-4 to R-12 (centre glazing). This increase in thermal performance is achieved through various combinations of low-e coatings, low-conductive gas fill and additional glazing layers.

For high thermal performance glazing, one option is for the low-e coating to be applied to a heat shrinkable film which is incorporated within two outer glazing layers. The method of manufacturing this type of sealed glazing unit is described in U.S. Pat. No. 4,335,166. A particular production problem is that in order to avoid corner wrinkling of the film following the heat shrinking process, steel spacers are used in preference to aluminum because of the higher stiffness and rigidity of the steel spacer.

Particularly in buildings where there is a high risk of vandalism, plastic sheets may be used instead of glass in the manufacture of the sealed units. The benefits of using plastic instead of glass are improved security, reduced maintenance costs and increased safety with no threat of glass breakage.

The main drawback of using plastic instead of glass is early failure of the sealed unit which is caused by two main factors. One cause is increased moisture build-up and desiccant degradation resulting from the comparatively high permeability of the plastic glazing material. A second cause is premature seal failure resulting from the increased expansion of the glazing layers due to the higher coefficient of expansion of the plastic glazing material. A further drawback is that because of the build-up of moisture within the sealed unit, high performance low-e coatings cannot be typically incorporated into sealed plastic glazing units because these coatings will degrade rapidly. Similarly, because of the permeability of the glazing material, low-conductive gas fill cannot be incorporated within the sealed glazing unit, because over time the gas will diffuse out of the unit.

For high security glazing, laminated sheets of glass and plastic are used. However, because of the higher coefficient of expansion of the plastic, the plastic sheets are typically laminated between two glass sheets in order to evenly constrain the plastic sheets and help prevent delamination of the glazing layers.

Although most multiple glazed units incorporate conventional metal hollow profile spacers, there are other more specialized types and designs of sealed units incorporating metal spacers. Two particular specialized designs of sealed units are highlighted.

One specialized design of a sealed glazing unit which is used for structural spacer glazing incorporates a metal channel-shaped spacer which is used in combination with a deformable sealant tape, containing desiccant. The two legs of the spacer are separately bonded to the glazing layers with structural silicone sealant. The design of structural spacer glazing units is described in detail in U.S. Pat. No. 4,552,790. An interesting application of structural spacer glazing is for flush glazed, openable windows. With this type of window design, there is no need for a separate sash frame and the opening window hardware, weatherstripping and related components are directly fixed to the sealed unit. A key advantage of this type of design for high thermal performance glazing is that without the supporting frame, there is increased energy efficiency. First, there are higher solar gains through the increased glazing area. Second, there are lower heat losses through the reduced perimeter frame area. A particular problem of using a metal spacer for flush glazed windows is that holes cannot be drilled in the metal spacer as the metal spacer functions as a moisture barrier and the integrity of the moisture vapour barrier must be retained to order to maintain the integrity of the edge seal. Consequently, it is comparatively difficult to fix the different window components such as hinges and opening hardware to the sealed unit.

A second specialized design of sealed unit is manufactured with a continuous strip product which combines spacer and sealant in a single product. The metal spacer is a flat metal strip bent in a continuous zigzag profile which is embedded within an elongated ribbon of deformable sealant containing desiccant. The product which is described in U.S. Pat. No. 4,431,691 by Greenlee is marketed commercially under the name of Swiggle Strip TM by Tremco Inc. of Cleveland, Ohio.

As with conventional sealed units, the main problem of using metal spacers for these specialized designs is that the highly conductive metal spacer acts as a thermal bridge creating heat loss and condensation around the inner perimeter of the sealed unit. Again as with conventional units, this problem of perimeter edge heat loss is now becoming more significant with the introduction of high thermal performance glazing units.

In order to address this problem of perimeter edge heat loss, various efforts have been made over the past twenty years to use lower conductive plastic materials instead of metals for manufacturing the spacer bar. However, these efforts to substitute conventional thermoplastic materials have not proved to be successful as plastics are generally unsuitable as materials for manufacturing spacer bars. The main drawbacks of conventional plastic materials include: high coefficient of thermal expansion, poor UV stability, high moisture vapour and gas transmission, low rigidity or stiffness, poor thermal stability with volatile outgassing and stress relaxation etc.

In order to overcome these drawbacks with conventional thermoplastic materials, more complex designs for the spacer have been developed using reinforced engineering grade plastic materials. One approach documented in U.S. Pat. No. 4,479,988 uses a glass fibre filled polycarbonate extrusion. The advantage is that the coefficient of expansion of the glass fibre filled polycarbonate is somewhat reduced, however, the coefficient of expansion is still higher than glass.

Another approach documented in U.S. Pat. No. 4,551,364 and in U.S. Pat. No. 4,564,540 uses a fibreglass pultrusion. Again, the advantage is that the coefficient of expansion of pultruded fibreglass is reduced and in this case is almost the same as the coefficient of thermal expansion of glass.

These efforts to develop reinforced plastic spacers have not at present proved to be commercially successful. There appears to be five main factors that account for the lack of commercial success of reinforced plastic spacer bars.

One factor is that the costs of manufacturing reinforced plastic spacers are comparatively high for both the extruded and pultruded spacers. For the extruded spacer, production and material costs are high because each spacer is individually extruded using engineering grade plastic resins filled with glass fibres and because of the glass fibre fill, the extrusion dies have to be replaced at regular intervals. For the pultruded spacer, the costs of setting up to manufacture a specific profile are high. In addition, the walls of the pultruded profile are relatively thick and contain a high percentage of glass fibre content and as a result, the material costs are comparatively high and the dies again have to be replaced at regular intervals.

A second factor is that even with the glass fibre fill reinforcement, the reinforced plastic materials remain comparatively permeable. Consequently, there is the concern that over time moisture vapour will permeate into the sealed unit through the walls and corner connections of the plastic spacer frame and in the long term, this transmission of moisture will cause desiccant degradation and eventual failure of the sealed unit. This problem is particularly significant where silicone is used as the outer sealant in manufacturing the sealed unit. Similarly for gas-filled units, there is also a concern that the low-conductive gas will permeate through the plastic spacer and over time this will result in reduced thermal performance.

A third factor is that reinforced plastic spacers can cause increased sealant stress and this increased stress can result in premature failure of the sealed unit. For the extruded reinforced spacer, the increased sealant stress is due to the fact that the coefficient of expansion of the fibre filled polycarbonate is higher than the coefficient of expansion of the glass. For the pultruded spacer some sealed unit manufacturers consider that there is increased sealant stress due to the extreme rigidity and stiffness of the thick wall spacer profile.

A fourth factor is that reinforced plastic spacers can create production problems. For the extruded spacer, the thin cross-section with glass fibre fill means that the spacer cannot be easily thermally welded together if desired. For the pultruded spacer, the high percentage of glass fibre fill means that very high dust levels are created when the spacer is cut with a saw. The fine dust is difficult to clean off the spacers for clean assembly of sealed units.

A fifth factor is that for the extruded polycarbonate spacer, the problem of volatile outgassing at high temperatures has not been resolved and sealed units fabricated using the polycarbonate spacer at present have difficulty passing certain durability testing requirements for sealed units.

SUMMARY OF THE INVENTION

By fabricating a multiple glazed sealed unit with an insulated spacer made from oriented thermoplastic polymer material it has been found that the problems with the prior art have been overcome. In particular, it has been found that some of the apparent drawbacks of using an oriented thermoplastic material for manufacturing insulated spacers can be used to advantage in the design of the product.

Accordingly, the present invention provides a multiple layer sealed unit comprising at least two glazing layers arranged in a parallel spaced relation and with an insulating spacer made from oriented thermoplastic polymeric material interposed and adjacent to the periphery of the glazing layers. The required physical properties of the insulating spacer are substantially governed by controlling the degree and directions of the oriented molecular structure of the thermoplastic material or materials from which it is formed. Typically, the orientation of the polymer material of the insulating spacer is largely in the longitudinal axis of the spacer.

The present invention also provides an insulating spacer for multiple layer sealed units which is formed from an oriented thermoplastic polymeric material. Among other physical properties of the spacer, the thermal conductivity, coefficient of thermal expansion and dead bend properties of the spacer are governed by controlling the degree and directions of orientation of the molecular structure of the material from which it is formed.

Various methods can be used to manufacture the oriented thermoplastic material and generally these methods involve some way of drawing or stretching the isotropic material. This process of drawing or stretching the thermoplastic material aligns or orientates the molecular structure of the isotropic polymer and results in a material with substantially modified properties. These modified properties are anisotropic. The properties of the material in the direction of draw are very different from the properties of the material perpendicular to the direction of draw. The material properties also vary significantly depending on the type of polymer and in particular whether the polymer is crystalline or amorphous in molecular structure. Generally, it is the more highly crystalline polymers that are most affected by the process of orientating the polymer structure. Further, in general, the higher the draw ratio, the greater the degree of modification of the physical properties of the oriented thermoplastic polymer.

For insulated spacers, the modified and improved properties of the oriented thermoplastic material make it feasible to manufacture insulated spacers from conventional thermoplastic materials usually without the need for additional reinforcement. The use of oriented thermoplastic material results in four main improvements.

One improvement is higher strength and stiffness in the direction of draw. The advantage of these improved structural properties is that without the need for glass fibre reinforcement, the profile wall thickness of the oriented thermoplastic spacer can be thin, lowering the cost and weight of the spacer and also reducing conductive heat loss through the thin wall profiles. The increased stiffness of the insulating spacer profiles also speeds up the assembly process for the sealed unit as the spacer frame can more easily be laid down on the glass so that the sides of the frame are parallel to the edges of glazing sheets.

A second improvement is enhanced resistance to ultraviolet (UV) radiation degradation. The advantage of improved weatherability is that for certain types of thermoplastic materials, there is no need for a separate UV barrier and the front face of the oriented plastic spacer will not dust or flake even after prolonged exposure to sunlight. Also, colour fading of the plastic material will be reduced.

A third improvement is enhanced high temperature stability. One advantage of improved temperature resistance is that the spacer is not deformed by the application of hot sealant during the fabrication of the sealed unit. A related issue is that the improved thermal stability of the oriented thermoplastic material helps prevent outgassing at elevated temperatures which causes fogging of the sealed unit due to volatile plastic materials condensing on the inner cold surfaces of the glass. The improved thermal stability of the material also eliminates the problem of stress relaxation.

A fourth improvement is enhanced barrier properties. The advantage of a lower rate of moisture vapour transmission is that without the need for a separate barrier coating, certain types of oriented plastic materials have the necessary barrier properties to ensure long term performance for the sealed unit. Similarly, the enhanced barrier properties of the oriented thermoplastic material help reduce the loss of low-conductive gas from the sealed unit.

As well as these improved properties, the process of producing the oriented spacer also results in modified material properties that are not on their face, apparently advantageous or compatible with the requirements of an insulated spacer for sealed glazing units.

One such property is that the thermal conductivity parallel to the direction of draw is increased. The conductivity perpendicular to the direction of draw, however, is somewhat decreased. We have found that by ensuring that the direction of orientation is located largely in the longitudinal axis of the spacer, advantage can be taken of the lower conductivity perpendicular to the direction of draw with the result that heat loss across the edge seal is reduced.

A second property which is a considered drawback, is negative thermal expansion along the draw direction. For an insulated spacer, in order to avoid sealant stress, the coefficient of thermal expansion of the polymer material should substantially match the coefficient of positive expansion of the glass within the temperature range of −30° C to +60° C. Our research has shown that this problem of negative expansion can be overcome and the coefficient of expansion in the longitudinal axis can be fine tuned to match the coefficient of expansion of glass.

A third property which is a considered drawback is that the polymeric oriented material in the direction of draw exhibits dead bend properties. Like a metal, the material can be dented on impact. For an insulated spacer, however, advantage can be taken of this "nuisance" property. One example is where the spacer frame is fabricated by cold forming or bending the spacer bar around the corners or partly cutting or V notching the spacer and then bending the spacer bar around the corners. The advantages of the bent-corner spacer frame are, more efficient assembly of the sealed unit particularly with automated production methods and improved durability of the sealed unit with reduced moisture vapour transmission and low-conductive gas loss at the corners.

The process of manufacturing the oriented plastic sheets or profiles does not alter other key properties of the polymer material that makes thermoplastic materials more suitable than metals as materials for manufacturing spacer bars. These improved properties include: light weight, no corrosion, heat weldable, ease of handling etc.

The property of the oriented thermoplastic spacer being heat weldable is particularly advantageous for three reasons. First, in the fabrication of a bent-corner spacer frame, it is easy to heat weld the final joint connecting the two ends of the spacer bar. Second, with gas filling the units, it is easy to seal up the holes after the nozzles of the gas filling equipment are removed. Third, in the fabrication of sealed units incorporating glass and plastic laminated glazing sheets or plastic glazing sheets or films, the thermoplastic spacer can be bonded to the plastic glazing material.

According to a feature of the present invention, the sealed unit can incorporate sealant wetted out and adhering to the spacer and to at least one or both of the glazing layers depending on the design configuration of the spacer. The sealed unit can also incorporate additional inner glazing layers arranged in a parallel and spaced relationship to the outer glazing layers. The glazing layers can be glass sheets or thermoplastic sheets or heat shrinkable plastic films. Where thermoplastic glazing sheets or films are used, the films or sheets can be bonded directly to the oriented thermoplastic spacer.

Where the outer glazing layers are plastic sheets or laminated sheets of glass and plastic, the oriented thermoplastic spacer can be bonded around the periphery of the outer glazing sheets and no sealant is necessary for the fabrication of the sealed unit.

For sealed plastic glazing units in particular, the use of the oriented plastic spacer results in substantial improvements in the performance of the sealed unit especially where the outer glazing sheets are also made from transparent oriented thermoplastic sheet material.

First the fabrication of the glazing unit is simplified because there is no need for outer sealant. Second, the durability of the sealed plastic glazing unit is improved because of the enhanced barrier properties of the oriented thermoplastic polymer. Third, the heat loss through the edge seal is reduced as compared to solid sealant, the thin walls of the oriented thermoplastic spacer create a minimal thermal bridge. Fourth, the energy efficiency of the sealed plastic glazing unit can be substantially improved as it is feasible because of the improved barrier properties of the plastic glazing to incorporate low-e coatings and low-conductive gas fill. Also, because of the strength of the oriented plastic glazing, it is feasible to fabricate thick air space sealed units incorporating multiple layers of low-e coated, heat shrinkable plastic films. Compared to conventional double glazing (R-2) the thermal performance of these thick airspace, low-conductive gas filled, multiple-layer sealed plastic glazing units can be in excess of R-16. A particular advantage of using these high thermal performance, sealed plastic glazed units for openable, flush glazed windows is that the various window components such as opening hardware, hinges and weatherstripping can be easily bonded to the oriented thermoplastic glazing and spacer.

For plastic sealed glazing units, the outer plastic glazing sheets are typically manufactured from biaxially oriented thermoplastic material or biaxially oriented thermoplastic material bonded to glass sheets. In contrast to conventional laminated glazing of glass and plastic, the biaxially oriented thermoplastic material does not have to be sandwiched between glass sheets as the coefficient of expansion of the oriented thermoplastic material can be fine-tuned to match the coefficient of expansion of glass. The advantage is that the fabrication of the sealed unit is simplified as the oriented thermoplastic spacer can be bonded directly to the inward facing plastic layers of the laminated glazing sheets.

In the fabrication of the spacer frame for the insulated glazing unit, the oriented thermoplastic spacer bars can be conventionally assembled into a generally rectangular-shaped frame using corner keys. Alternatively, the spacer frame can be assembled by cold forming or bending the spacer bar around the corners or partly cutting or V notching the spacer bar and then bending the spacer bar around the corners. To complete the bent-corner spacer frame, the two ends of the spacer bar can then be thermally welded or sealed together.

Conventional hollow profile oriented thermoplastic spacers can be manufactured in various ways including extruding the spacer as individual profiles with the material being oriented as part of the production process, or alternatively, roll-forming the spacer from flat strips of already oriented thermoplastic sheet material. The oriented thermoplastic material typically only exhibits increased dead bend properties in the direction of draw. For the roll-formed spacer, in addition to the need for orientation in the longitudinal axis of the spacer, there is also a need for some degree of orientation normal to the longitudinal axis of the spacer to allow roll-forming as well as bending of the spacer profile.

This biaxial orientation can be achieved in various ways, including: biaxially orientating the sheet during production or laminating two or more layers of oriented thermoplastic sheets together so that the direction of draw of one sheet is normal to the direction of draw of the other sheet.

The biaxially oriented sheets may be manufactured using a crossroll stretching process where the material is orientated in opposing diagonal directions to the longitudinal axis of the sheet material. In this instance and with this production method, the required material properties in the longitudinal axis of the spacer can be achieved where the main direction of orientation may not be largely in a direction longitudinal to the axis of the spacer.

Generally in the fabrication of the sealed unit, the hollow profile spacer contains desiccant and the side of the spacer facing the airspace typically incorporates perforated holes or a slot so that the desiccant material can absorb moisture from the air within the sealed unit. Where the profiles are roll-formed, one option is for the edges of the plastic sheet to be intermittently thermally welded together creating a continuous but perforated seam on the side of the spacer facing the airspace.

The spacer can be manufactured from different types of thermoplastic polymer materials. One option where no sealant is used or alternatively where a very permeable outer sealant such as silicone is used, is to fabricate the spacer from a thermoplastic material which already has very good barrier properties and further improve these properties through the process of orientation. One preferred material is vinylidene chloride (Saran TM) and in addition to its very good barrier properties, a further advantage of using Saran TM is that all common types of sealant material adhere strongly to it.

Depending on the type of thermoplastic material used for the spacer, the spacer may incorporate a separate moisture vapour film or coating or a separate UV barrier on the front face. Where the spacer is roll-formed from flat strips cut from sheet material, the required coatings or films are first laminated or applied to one or two surfaces of the sheet material. The hollow profile spacer is then manufactured in such a way that after the hollow profile spacer is roll-formed, the coatings or films are located on the appropriate surface of the spacer.

Various profile designs of the oriented thermoplastic polymer spacer can be used for different specialized sealed glazing applications. One example is where the spacer is used for structural spacer glazing. A second example is where the spacer is a continuous zigzag bent flat strip which is embedded within an elongated ribbon of deformable sealant containing desiccant material.

At present, building panels used as part of the building envelope are not fabricated as multiple layer sealed units. However, because of the advances made in developing high thermal performance sealed glazing units, there are now advantages in using the same edge seal technology developed for glazing units for the fabrication of opaque insulating panels. These advantages of using sealed opaque panels for the building envelope include: the ease of future upgrading of the thermal performance of the building envelope and the ease of maintaining and repairing the required air barrier incorporated within the building envelope. These panels can provide more insulation per unit thickness than conventional insulation materials used at present in the building envelope. The outer opaque layers used to manufacture these high thermal performance sealed panels can be made from a variety of impermeable materials including: thin stone or marble sheets backed with metal or biaxially oriented thermoplastic sheets.

BRIEF DESCRIPTION OF DRAWINGS

The following is a description by way of example of certain embodiments of the present invention, reference being had to the accompanying drawings, in which.

DETAILED DESCRIPTION

Figure 1:
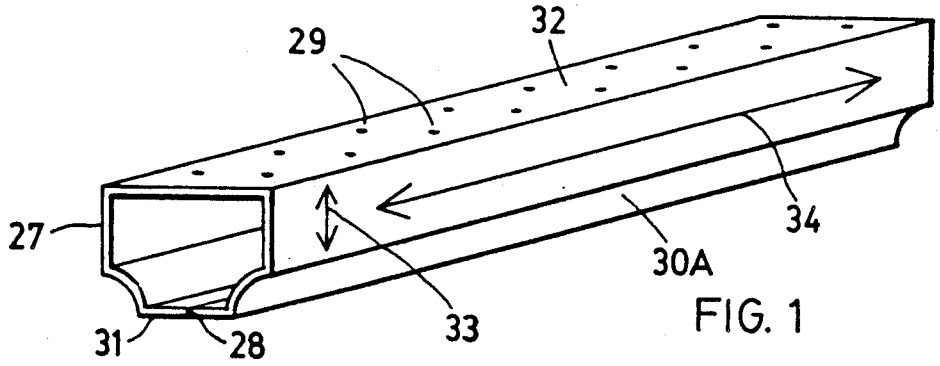
FIG. 1 shows a drawing of a roll-formed oriented thermoplastic spacer.

FIG. 1 shows a spacer 30A for multiple layer sealed units which are used for such applications as windows. The insulating spacer is of conventional cross section but according to the invention is of oriented thermoplastic material rather than metal, conventional plastic or reinforced plastic material.

There are essentially two known methods for producing oriented polymeric material. One method is to produce an aligned extended structure in the polymer melt or solution which is followed by or associated with crystallization which may involve the formation of a liquid crystal phase. A second method for producing oriented polymeric material is based on the solid state deformation and concomitant orientation of the orientable thermoplastic polymers. Solid-phase deformation processes include: extrusion drawing, tensile drawing, hydrostatic extrusion, ram extrusion, die drawing, and roll press stretching. Generally the different processes involve in some way drawing or stretching the isotropic material. As an example, the specific technique of die drawing is described in U.K. Pat. No. 2,060,469.

The present oriented thermoplastic spacer is typically manufactured using solid-phase deformation processes. For solid-phase deformation processes, the degree of orientation is largely determined by the draw ratio although other factors such as temperature, pressure and the type of production process also play a role. The process of orientating the isotropic material enhances key properties of the thermoplastic polymer material and it is these modified properties that allow the insulating spacer to be manufactured from commodity or intermediate grade thermoplastic polymeric materials.

For an insulating spacer to function and perform satisfactorily within a sealed glazing unit, a number of demanding material requirements must be met. We have found that these demanding requirements can be obtained through controlling the degree and directions of orientation of the molecular structure of the thermoplastic material from which the spacer is made.

One required property for the insulating spacer 30A is strength and stiffness in the longitudinal axis of the spacer as shown by arrow 34. In general, the higher the draw ratio, the greater the strength and stiffness of the material in the draw direction which should be parallel to the longitudinal axis of the spacer. However, compared to other uses of the ultra drawn oriented thermoplastics, very high draw ratios are not necessarily required to manufacture an insulated spacer as the need for strength and stiffness must be offset against the other requirements of an insulated spacer.

A second property for an insulating spacer is dimensional stability in the longitudinal direction of the spacer as shown by arrow 34. Particularly where the outer glazing layers are glass, the coefficient of thermal expansion of the oriented thermoplastic spacer should substantially match the positive coefficient of expansion of glass between the temperatures of $-30°$ C to $+60°$ C.

Generally, at high draw ratios, most crystalline thermoplastic materials exhibit a negative coefficient of thermal expansion. However, the negative coefficient of thermal expansion of the oriented thermoplastic material in the draw direction can be fine-tuned to match the positive coefficient of thermal expansion of glass. This can be achieved in three main ways.

First, the type of polymeric material used has to be carefully selected as the coefficient of thermal expansion varies significantly depending on the type of oriented thermoplastic material used. Materials such as low density polyethylene have a very high rate of negative thermal expansion while materials such as polypropylene have a lower rate. Second, the rate of negative thermal expansion increases with draw rates. At low draw rates, the rate of thermal expansion is positive while at high rates, the rate becomes negative. Through careful optimization, the coefficient of expansion can be made slightly positive to again match the coefficient of expansion of glass. Third, the coefficient of thermal expansion can also be increased by annealing the oriented thermoplastic material at high temperatures.

A third required property for an insulating spacer is low moisture vapour and gas permeability. Research has shown that the permeability of oriented thermoplastic material is sensitive to draw ratio. For example for polyethylene, the permeability of the polymer is reduced dramatically as the draw ratio is increased from 5 to 10.

A fourth required property is low conductivity normal to the longitudinal axis of the spacer (shown by arrow 33). Generally, the thermal conductivity of the oriented material normal to the draw direction decreases with increasing draw ratio although after a draw ratio of about 5, increasing the draw ratio typically does not result in further substantial reductions in thermal conductivity.

Other required properties include thermal stability and UV resistance and, it is found that these properties are also enhanced by increasing the draw ratio.

Where the spacer is used to manufacture bent-corner spacer frames a further required property is that the spacer 30A can be stretch formed or bent around the corners (see FIG. 5).

Through the appropriate control of draw ratio and production conditions, and these optimum ratios and conditions vary by material type, a number of different types of thermoplastic materials can provide the required properties for a insulating spacer, including: polypropylene, high density polyethylene and polyethylene terephthalate.

Insulating hollow profile spacers 30A as shown in FIG. 1 can be manufactured in various ways including extruding the spacer in profile form so that the material is oriented as part of the production process or by roll-forming the hollow profile spacer from flat strips cut from sheet material which has been previously oriented. The specific design illustrated in FIG. 1 is for a roll-formed spacer.

The hollow profile spacer 30A is roll-formed from flat strips of oriented thermoplastic material using similar production methods as are used to manufacture metal roll-formed spacers. As shown in FIG. 1 after the hollow profile section is roll-formed, the two edges of the flat strip of material are heat welded together creating an invisible seam 28 parallel to the longitudinal axis of the spacer as shown by arrow 34. The seam 28 as shown in FIG. 1 is on the backside 31 of the spacer although alternatively, the seam 28 can be located on one of the sides 27 of the spacer or on the front face 32 along the longitudinal axis of the spacer.

When installed within a sealed unit, the spacer 30A usually incorporates disiccant material contained within the hollow profile. The desiccant material must be in moisture communication with the air-space enclosed by the glazing layers. As shown in FIG. 1, one way that this can be achieved with either the extruded or roll-formed spacer is by incorporating perforations 29 on the front face 32 of the spacer 30A. A second way, particularly for roll-formed spacers is to incorporate a continuous slot along the front face 32 of the spacer 30A. A third way, again particularly for roll-formed spacers, is for the edges of the oriented thermoplastic sheet to be intermittently welded together creating a continuous but perforated seam. Compared to a continuous slot, the advantage of an intermittently welded slot is a more rigid profile which allows the wall thickness of the spacer to be reduced.

Where the spacer is roll-formed from flat strips, it is necessary that the sheet has dead bend properties, both parallel and normal to the longitudinal axis of the spacer as shown by arrows 34 and 33. To achieve dead bend properties in two directions typically requires that the thermoplastic material is also oriented in at least two directions. This arrangement can be achieved in different ways.

One way is to manufacture the strips from oriented thermoplastic sheets where the material is oriented at least biaxially. The biaxially oriented sheets may be manufactured using a type of crossroll stretching process where the material is orientated in two opposing diagonal directions from the longitudinal axis of the spacer. It should be noted that by balencing the degree and directions of the orientation of the sheet material produced using the crossroll production process, the required properties of the spacer in the longitudinal axis can still be acheived even though the main direction and degree of orientation may not be largely in the longitudinal axis of the spacer as shown by arrow 34.

A second way is to cut the strips from sheets of oriented thermoplastic material which are laminated from at least two layers. One of the layers may be oriented to a greater degree than the other and the layer with the greater degree of orientation is located so that the direction of draw is parallel to the longitudinal axis of the spacer as shown by arrow 34. The second sheet is located so that the direction of draw (as shown by arrow 33) is normal to the longitudinal axis of the spacer. In roll-forming the spacer from the laminated sheet material, the first layer where the direction of orientation is longitudinal to the axis should become the outer surface on the side 27 of the spacer adjacent to the glazing layers (see FIG. 3) and the second layer should become the inner surface of the spacer. This arrangement is preferred as the layer with reduced thermal conductivity on the outside of the spacer 30A helps prevent heat flow to the inner layer with increased thermal conductivity.

Although the process of orientating the thermoplastic material generally improves the barrier properties of the material, for certain applications where no outer sealant is used or alternatively where a very permeable outer sealant such as silicone is used, there is a need to further improve the barrier properties of the spacer.

One way that the barrier properties can be improved is to manufacture the spacer 30A from a thermoplastic material which already has very good barrier properties and further improve these properties through the process of orientation. One preferred material is polyvinylidene chloride (Saran TM) and in addition to its very good barrier properties, a further advantage of using Saran TM is that all common types of sealant material adhere strongly to it. A second way that the barrier properties can be improved is to add a separate moisture vapour and gas barrier film or coating to at least the back 31 and sides 27 of the spacer 30A.

Compared to an extruded profile, a particular advantage of a roll-formed spacer 30A manufactured from strips cut from oriented thermoplastic sheets is that the sheets can be more easily laminated or coated with one or more layers of high barrier materials. These high performance barrier materials and coatings can include: EVA, EVOH (Eval TM), PVdC (Saran TM), and metallised coatings on PET film.

In addition to the need for a separate barrier film or coating there may also be a need with certain types of plastics for a separate UV resistant film or coating on the front face 32 of the spacer 30A.

Figure 2:
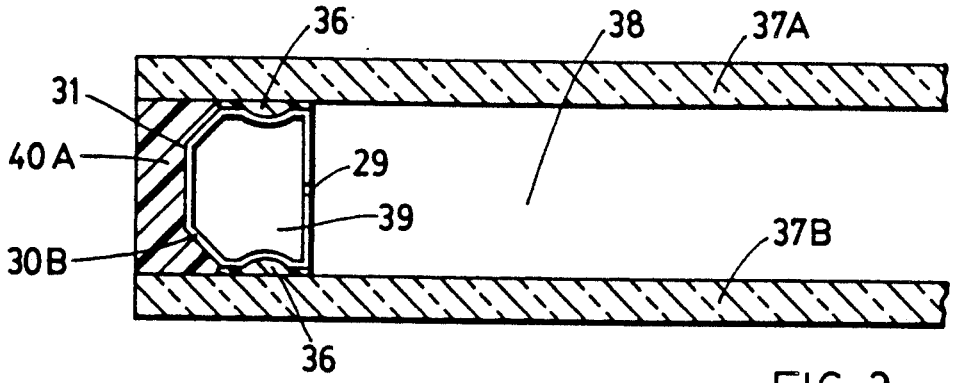
FIG. 2 shows a detail in cross-section of a dual seal double glazed unit incorporating an oriented thermoplastic spacer.

FIG. 2 shows a dual seal unit with an oriented thermoplastic polymer spacer 30B. As with a conventional dual seal unit, beads of polyisobutylene sealant 36 are applied to the sides of the hollow profile spacer 30B. The spacer 30B is formed into a spacer frame as will be explained more fully hereinafter. The preassembled spacer frame is interposed between the first glazing layer 37A and the second glazing layer 37B, adjacent to the periphery of the glazing layers. Typically the orientation of the polymer material of the spacer 30B is largely in the longitudinal axis of the spacer.

Figure 3:
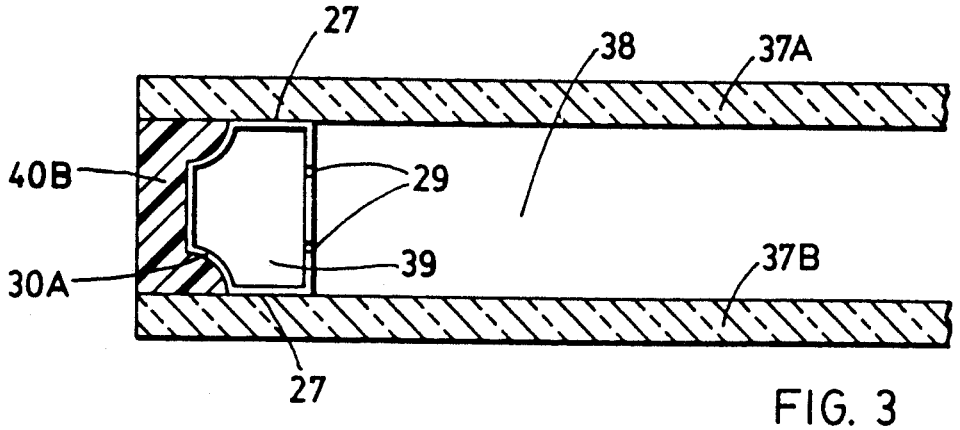
FIG. 3 shows a detail in cross-section of a single seal double glazed unit incorporating an oriented thermoplastic spacer.

Sealant 40A is applied in the outward facing channel around the periphery of the glazing sheets 37A and 37B. The sealant 40A must adhere to the back 31 of the spacer 30B and for certain types of thermoplastic materials, it may be necessary to treat or prime the spacer 30B to ensure good adhesion. The spacer 30B contains desiccant material 39 and typically incorporates perforations 29 to allow airflow between the desiccant material 39 and the air or low-conductive gas 38 within the sealed unit. FIG. 3 shows a cross-section of a single seal, double glazed unit incorporating a hollow profile oriented thermoplastic spacer 30A. The outer sealant 40B can be any sealant with good barrier properties such as hot melt butyl, polysulphide or polyurethane and so with this design because of the lower permeability of the outer sealant 40B, there is typically not the same need or requirement for the spacer 30A to be made from an oriented plastic with outstanding barrier properties or alternatively be coated with a separate moisture vapour and gas barrier film or coating.

Figure 4:
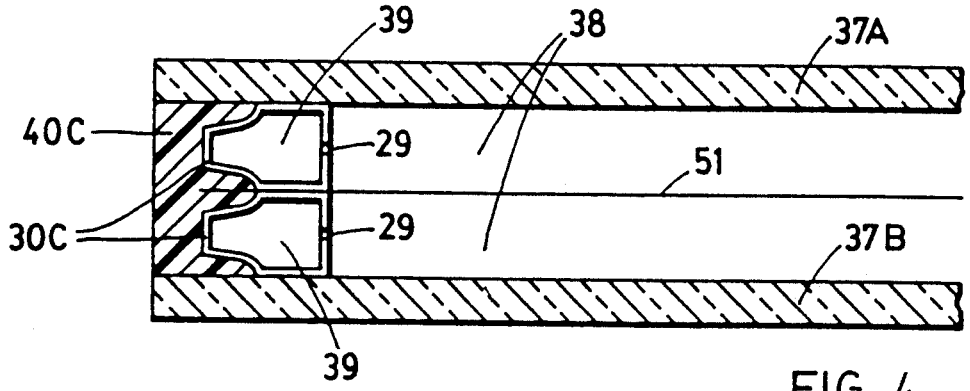
FIG. 4 shows a detail in cross-section of a triple glazed unit with an inner flexible, heat shrinkable film sandwiched between two oriented thermoplastic spacers.

FIG. 4 shows a detail of a cross-section of a triple glazed sealed unit where two oriented thermoplastic spacers 30C support a heat shrinkable plastic film 51 between two parallel and spaced apart glazing sheets 37A and 37B. The heat shrinkable plastic film 51 is typically made from polyethylene terephthalate (PET). The outer sealant 40C is typically polyurethane sealant. The sealed unit is generally manufactured using a known method such as that outlined in U.S. Pat. No. 4,335,166. The particular advantage of using oriented thermoplastic polymer spacers 30C for this application is that the spacers can be as stiff and rigid as steel spacers used to date. A further advantage is that the film 51 may be thermally bonded to the spacers 30C and this can simplify the assembly of multiple glazed units incorporating heat shrinkable flexible films.

Figure 5A:
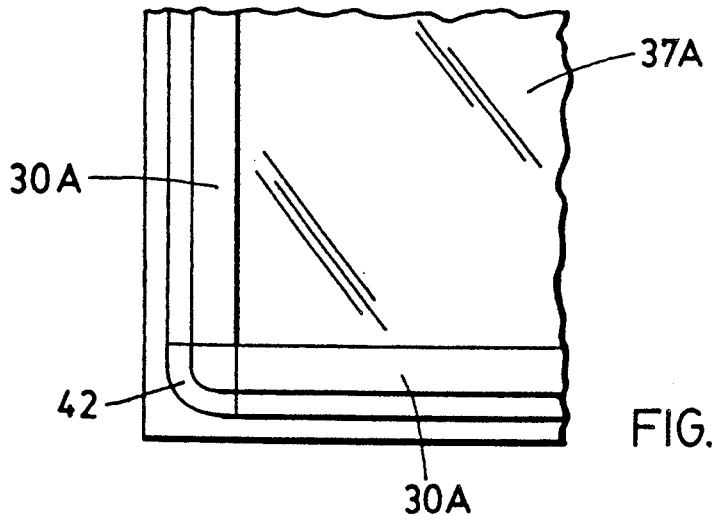
FIG. 5 shows detail plan views of three alternative corner constructions of spacer frames manufactured from oriented thermoplastic polymers.
Figure 5B:
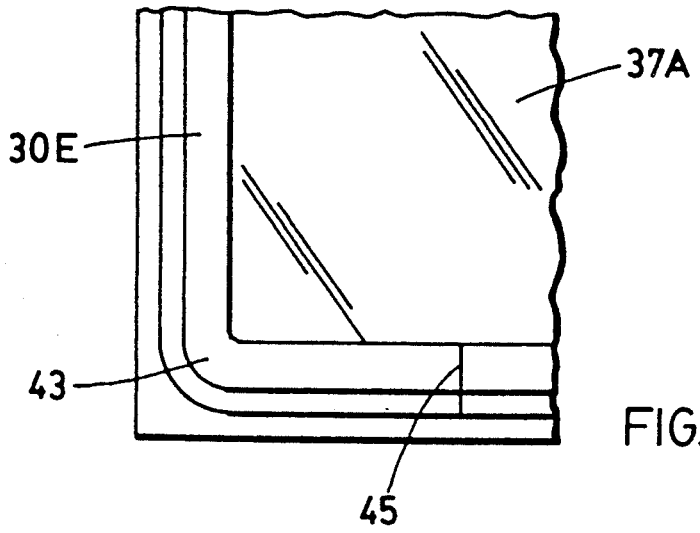
Figure 5C:
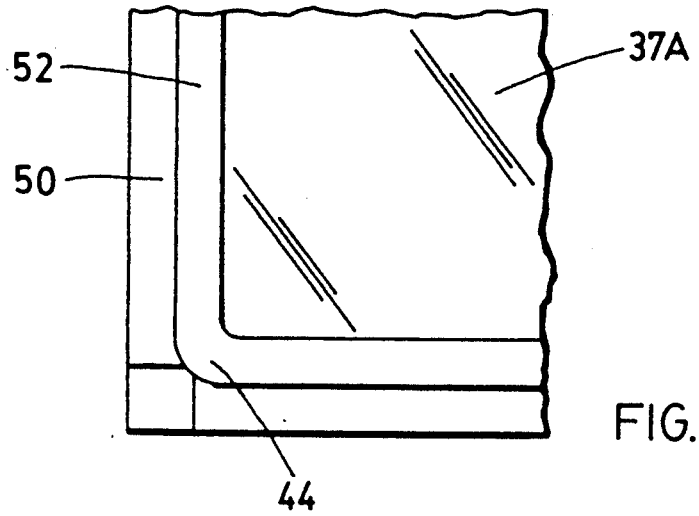

FIG. 5 shows plan views of three alternative corner details of spacer frames. In FIG. 5A, the two spacers 30A are conventionally joined with corner keys 42. In FIG. 5B, the spacer 30E is cold formed or bent around the corners 43 at room temperature or at slightly elevated temperatures. In fabricating the spacer frame from the oriented thermoplastic hollow profiles, similar equipment to that used for corner bending metal spacers can be used. The two ends of the rigid plastic spacer 30E can be thermally welded together as a butt joint 45 to ensure a continuous moisture vapour and gas barrier around the perimeter of the sealed unit. Alternatively, as shown in FIG. 5C, the spacer 50 can be partially cut and then bent around the corners 44. The specific corner detail shown in FIG. 5C is for structural spacer glazing (See FIG. 7).

Other alternative corner details of the spacer frames not shown in the drawings include: thermally welding and sealing the spacers together at the corners with a conventional mitre joint and V notching the spacer and then bending the spacer around the corner.

Figure 6:
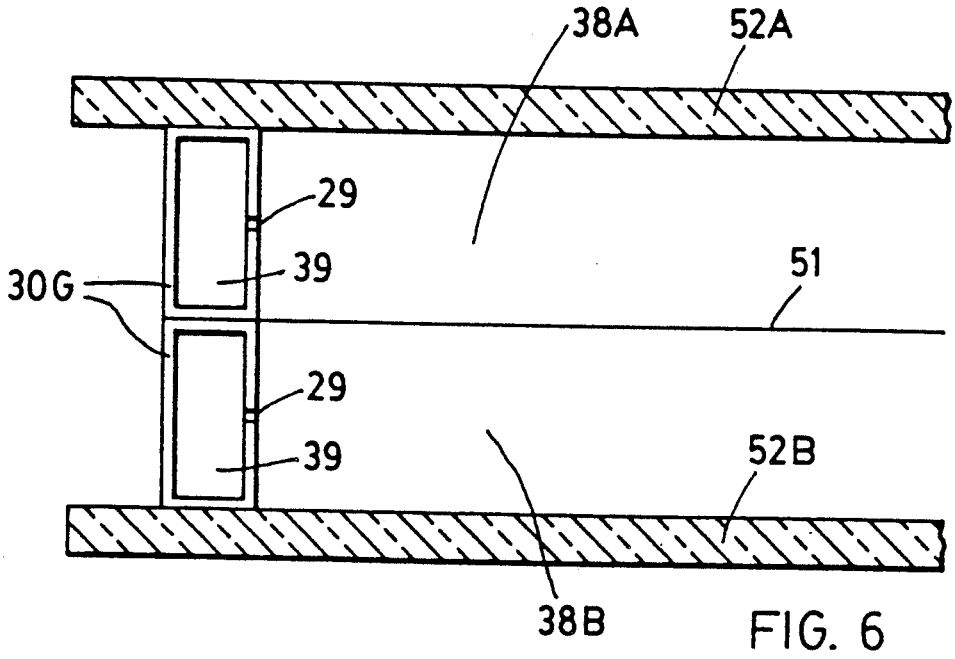
FIG. 6 shows a detail in cross-section of a triple glazed unit incorporating a heat shrinkable film where the oriented thermoplastic spacers are directly bonded to the glazing layers.

FIG. 6 shows a detail of a cross-section of a triple glazed sealed unit where two oriented thermoplastic spacers 30G support a heat shrinkable film 51 between two parallel and spaced apart glazing sheets 52A and 52B. The glazing sheets 52A and 52B can be biaxially oriented thermoplastic polymeric sheets or laminated sheets from glass and biaxially oriented thermoplastic polymeric material. Where laminated sheets are used, the oriented thermoplastic material is on the side of the glazing facing the airspaces 38A and 38B. The hollow profile spacers 30G contain desiccant material 39 and are bonded to the outer plastic sheets 52A and 52B respectively as well as to the film 51 and to each other.

Various processes can be used to directly bond the spacer to the plastic glazing sheets 52A and 52B including: magnetic heat sealing, adhesive bonding, ultrasonic sealing and solvent or thermal welding. No outer sealant is used and so the spacers 30G must have a very low rate of moisture vapour and gas transmission. As explained previously, this can be achieved by either manufacturing the oriented thermoplastic spacers from materials such as vinylidene chloride which have very good barrier properties or by incorporating a separate high performance barrier layer. Similarly, for long term durability of the sealed unit, the the plastic glazing sheets 52A and 52B must have a very low rate of moisture vapour and gas transmission and as with the spacer 30G this can again be achieved by either manufacturing the glazing sheet from an oriented thermoplastic material which has very good barrier properties such as polyvinylidene chloride or by incorporating a separate transparent high performance barrier layer.

As no outer sealant is used in fabricating the spacer frame, the corners must be hermetically sealed. This can be achieved by either manufacturing the spacer frame using the bent-corner method as described in FIG. 5B or by assembling the frame from separate pieces and hermetically welding the corners.

The biaxially oriented thermoplastic glazing sheets 52 can be manufactured from various thermoplastic materials. In addition to plastic glazing materials such as polycarbonates or acrylics which are conventionally used, other materials such as polypropylene and polyethylene may also be used as the process of orientating the material improves optical clarity.

The sealed unit in FIG. 6 incorporates a heat shrinkable film 51, typically PET which is also bonded to the spacers 30G. Although only a single film 51 is shown in FIG. 6, the sealed unit can incorporate multiple parallel layers of heat shrinkable film. Super high energy efficient sealed units (R-18 centre glazing) can be manufactured using low-e coated glazing sheets or heat shrinkable flexible films and filling the sealed unit with low-conductive krypton gas fill which allows reduced spacing between the glazing layers. For these thick airspace sealed plastic glazing units, there is no concern of breakage caused by pressure fluctuations within the sealed unit as the outer glazing sheets are made from essentially unbreakable, rigid oriented thermoplastic polymeric material.

Where the plastic sealed unit is used for flush glazed openable windows, weatherstripping, window hardware and hinges can be directly bonded to the plastic glazing and spacer. The unit is self supporting and there is no need for a separate sash frame. As a result, the cost of manufacturing the flush glazed, openable window is reduced.

Although the glazing sheets 52A and 52B are typically transparent, the layers may be translucent or opaque. Where the sheets are opaque, one option is to use laminated sheets made from biaxially oriented thermoplastic material bonded to thin sheets of stone or marble.

Different profile designs of the oriented thermoplastic polymer spacer can be used for a wide variety of specialized designs for sealed glazing units. One specialized design is for structural spacer glazing.

Figure 7:
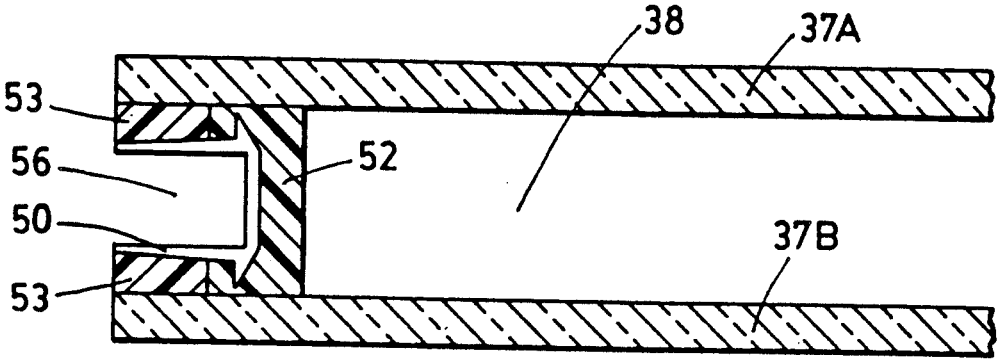
FIG. 7 shows a detail in cross section of a double glazed unit for structural spacer glazing incorporating a channel shaped oriented thermoplastic spacer.

FIG. 7 shows a detail of a cross-section of an oriented thermoplastic spacer 50 for a structural spacer glazing unit where the spacer is U shaped in profile creating a recessed channel 56 around the perimeter of the sealed glazing unit. The channel 56 is partially covered with a butyl tape 52 containing desiccant material. The spacer is bonded to the glazing sheets 37A and 37B with structural silicone sealant 53. In addition to reduced perimeter heat loss, a particular advantage of using the oriented thermoplastic spacer for this application is that the spacer frame can be very efficiently fabricated. As shown in FIG. 5C, the oriented thermoplastic channel spacer is partially cut through the back legs of the U channel and bent around at the corners. The two ends of the channel spacer are then thermally welded together at a butt joint creating a rigid bent-corner frame.

Figure 8:
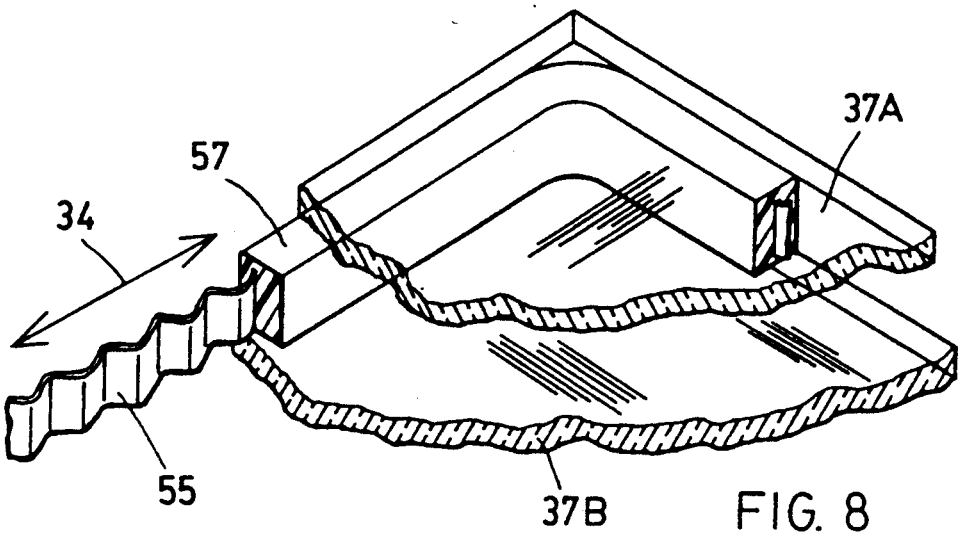
FIG. 8 shows a corner detail of a double glazed unit incorporating a deformable sealant edge seal with an oriented thermoplastic spacer strip.

FIG. 8 shows a detail drawing of a second specialized design for the oriented thermoplastic spacer which for this application is a spacing element 55 incorporated within an edge seal strip product 57. The continuous spacer element 55 of undulating shape is embedded within an elongated ribbon of deformable sealant containing desiccant material. The edge seal strip product 57 is placed around the periphery of the glazing layers 37A and 37B. The oriented thermoplastic material is used for the spacing element particularly because of its dead bend properties in the longitudinal axis which allow the oriented material to be very easily bent or folded creating the necessary zig-zag profile. However, in contrast to the conventional spacing element, the heat loss across the edge seal in a direction normal to the longitudinal axis of the spacer is reduced.

The drawings described herein illustrate only a very small representative sample of some of the possible design configurations for multiple-glazed sealed units incorporating the oriented thermoplastic spacer bar.

Further, for the different sealed unit designs illustrated herein, it is recommended for improved high thermal performance that the airspaces are filled with a low-conductive gas fill, that one glazing surface in each separate airspace is coated with a high performance low-emissivity coating and where appropriate a further glazing layer or layers may be incorporated between the outer glazing layers creating additional airspaces. To avoid repetition in the description of the drawings, specific reference has not been made in each case that the sealed units may incorporate these features. It should also be noted that hereinbefore, the space enclosed by the spacer and glazing layers has been referred to as an airspace, and that this specifically does not exclude the possibility that the space may be filled with an inert gas such as argon or alternatively, there may be no air enclosed and a partial vacuum may be maintained between the glazing layers. For good thermal performance, where air or argon gas is used, the optimum spacing between the glazing layers is about 14 mm. Where low-conductive krypton gas is used, the optimum spacing between the glazing layers is reduced to about 7 mm.

We claim:

1. An insulating spacer for interposition between at least first and second glazing layers of a multiple-pane sealed unit, which spacer is of a high draw ratio oriented thermoplastic polymeric material which is more highly molecularly oriented in the direction of the length thereof and which is free of reinforcing fibers, said material having a lower thermal conductivity in the direction between said first and second glazing layers than a material which does not have such a high draw ratio, being sufficiently highly drawn for having a coefficient of thermal expansion in the direction of the length of said spacer which substantially matches the thermal coefficient of expansion of said glazing layers, having dead-bend properties, having stiffness and rigidity sufficient to make a frame around the sealed unit self supporting, having ultra-violet resistance, and having moisture vapor and gas permeability less than said material which does not have such a high draw ratio.

2. A spacer as claimed in claim 1 where said insulating spacer is a profile extrusion and the orientation of said polymer material is largely in the longitudinal axis of the spacer.

3. A spacer as claimed in claim 1 where said insulating spacer is roll-formed from a flat strip of oriented thermoplastic polymeric material or materials.

4. A spacer as claimed in claim 1 in which said spacer is substantially U shaped in cross-section whereby providing a recess for receiving structural mounting fixtures.

5. A spacer as claimed in claim 1 where said spacer is a continuous undulating flat strip embedded within an elongated ribbon of deformable sealant containing desiccant material.

6. A spacer as claimed in claim 1 in which the degree and directions of orientation of the molecular structure of the thermoplastic material are such that the thermal conductivity of said spacer normal to its longitudinal axis is less than its thermal conductivity along its longitudinal axis.

7. A spacer as in claim 1 in which the degree of orientation of the molecular structure of the material in a direction normal to the longitudinal axis of the spacer is such as to provide adequate roll-forming and bending properties to the material.

8. A spacer as in claim 1 where said spacer is formed from oriented thermoplastic polymeric sheet material which is oriented in at least two directions and highly oriented in at least one.

9. A multilayered glazing unit comprising an insulating spacer interpositioned between at least first and second glazing layers, which spacer is of a high draw ratio oriented thermoplastic polymeric material which is more highly molecularly oriented in the direction of the length thereof and which is free of reinforcing fibers, said material having a lower thermal conductivity in the direction between said first and second glazing layers than a material which does not have such a high draw ratio, being sufficiently highly drawn for having a coefficient of the thermal expansion in the direction of the length of said spacer which substantially matches the thermal coefficient of expansion of said glazing layers, having dead-bend properties, having stiffness and rigidity sufficient to making a frame around the sealed unit self supporting, having ultra-violet resistance, and having moisture vapor and gas permeability less than said material which does not have such a high draw ratio.

10. The glazing unit as claimed in claim 9 where the glazing layers are oriented thermoplastic sheets and said spacer is bonded to said glazing sheets.

11. The glazing unit as claimed in claim 9 where the glazing layers are laminated from glass and oriented thermoplastic sheets and where said oriented thermoplastic sheet is on the side of the laminated glazing facing the air space and said spacer is bonded to said glazing sheets.

12. A glazing unit as claimed in claim 9 comprising at least one further glazing layer arranged between and in a parallel spaced relationship to said first and second glazing layers and on the opposite side of said insulating spacer from said first glazing layer; and a further insulating spacer made from said high draw ratio oriented thermoplastic polymeric material interposed between said third and second glazing layers; said further glazing layer being a heat shrinkable plastic film and said further plastic spacer having a rigidity and stiffness comparable with a conventional hollow-profile steel spacer.

* * * * *